US006526592B1

(12) United States Patent
Best

(10) Patent No.: US 6,526,592 B1
(45) Date of Patent: Mar. 4, 2003

(54) SCOOTER GLOVE

(75) Inventor: William B. Best, Norfolk, MA (US)

(73) Assignee: Franklin Sports, Inc., Stoughton, MA (US)

( * ) Notice: Subject to any disclaimer, the term of this patent is extended or adjusted under 35 U.S.C. 154(b) by 0 days.

(21) Appl. No.: 10/023,345

(22) Filed: Dec. 17, 2001

(51) Int. Cl.[7] ..... A41D 19/00
(52) U.S. Cl. ..... 2/161.1; 2/16
(58) Field of Search ..... 2/16, 20, 159, 2/160, 161.1, 161.2, 161.4, 161.6, 162, 163, 164, 169; 473/62; 602/21

(56) References Cited

U.S. PATENT DOCUMENTS

| | | | | | |
|---|---|---|---|---|---|
| 3,728,738 | A | * | 4/1973 | Andolino | 2/161.1 |
| 3,970,305 | A | * | 7/1976 | Hawkins | 473/62 |
| 4,011,596 | A | | 3/1977 | Chang | 2/16 |
| 4,071,913 | A | | 2/1978 | Rector | 2/20 |
| 4,183,098 | A | * | 1/1980 | Knowles, Jr. | 2/16 |
| 4,190,906 | A | * | 3/1980 | Patton, Jr. | 2/162 |
| 4,958,384 | A | | 9/1990 | McCrane | 2/20 |
| 5,435,007 | A | * | 7/1995 | Kalvestran et al. | 2/16 |
| 5,492,331 | A | * | 2/1996 | Kawakami | 2/161.2 |
| 5,537,692 | A | * | 7/1996 | Dorr | 2/16 |
| 5,600,849 | A | | 2/1997 | Hu | 2/16 |
| 5,722,092 | A | | 3/1998 | Borzecki et al. | 2/16 |
| 5,778,449 | A | | 7/1998 | Oetting et al. | 2/16 |
| 5,819,313 | A | * | 10/1998 | McCrane | 2/16 |
| 5,898,936 | A | | 5/1999 | Janes | 2/16 |

* cited by examiner

*Primary Examiner*—Gary L Welch
(74) *Attorney, Agent, or Firm*—Shook Hardy & Bacon

(57) ABSTRACT

A protective scooter glove that uses a semi-rigid support plate to protect the user's wrist from hyper-extending backward or side to side, an abrasion resistant palm panel to protect the user's palm and heel from abrasions, and padding to protect the user's heel and palm from impact injuries, all in the event of a fall. A semi-rigid support plate is attached to the back of the scooter glove by means of two sleeves. Two removably connected VELCRO straps tighten the semi-rigid support plate above the user's wrist and first knuckles to ensure optimal fit and comfort to prevent the plate from moving during wear.

7 Claims, 1 Drawing Sheet

FIG.1.
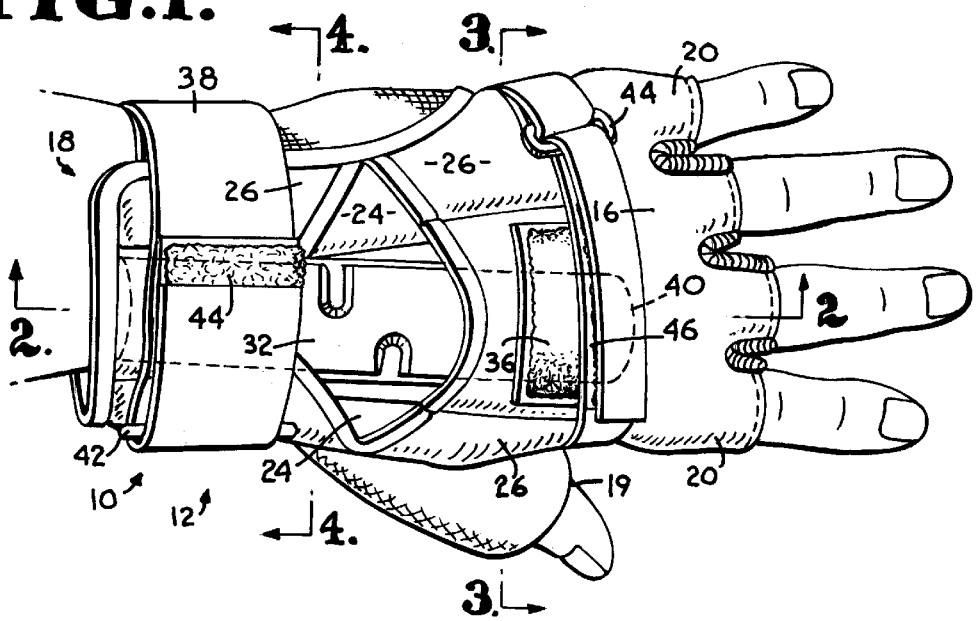
FIG.2.
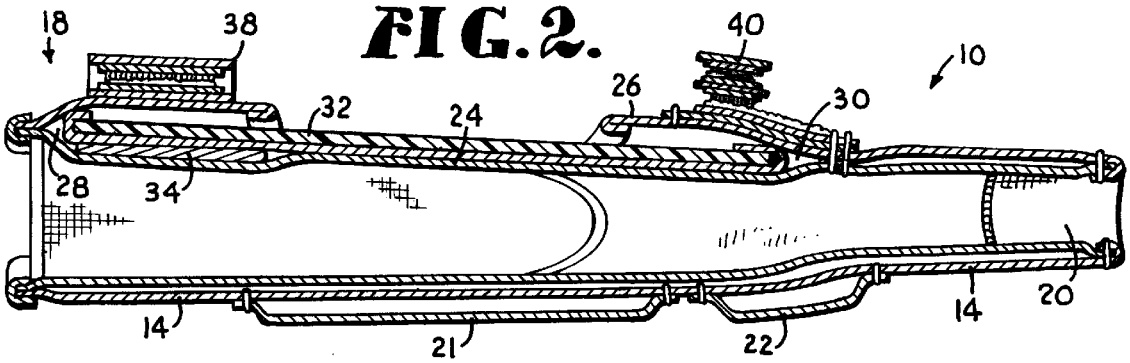
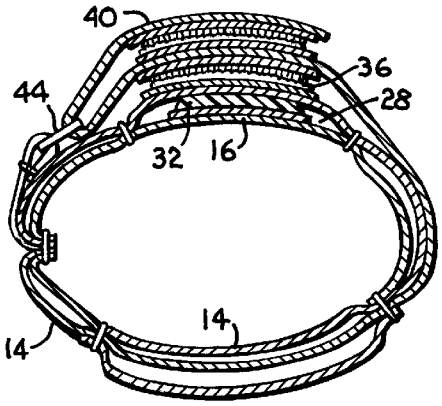
FIG.3.
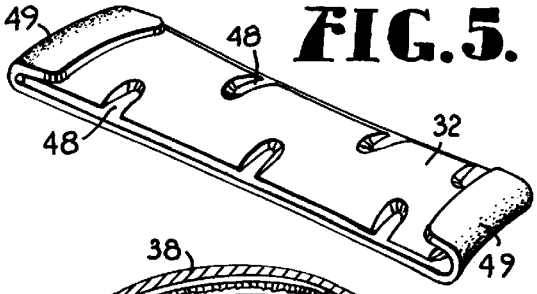
FIG.5.
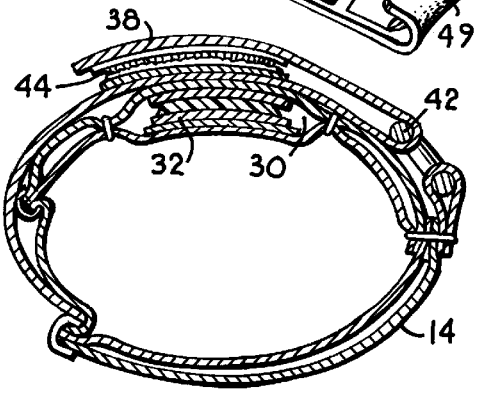
FIG.4.

SCOOTER GLOVE

BACKGROUND OF THE INVENTION

This invention relates to a protective device for use in activities in which there is a danger of wrist strain or breakage. More specifically, this invention relates to a protective glove that minimizes the risk of the user's hand hyper-extending backward or side to side, causing strain and/or breakage of the wrist.

In recent years, recreational activities such as in-line skating, skateboarding, and snowboarding have become more popular. These activities have resulted in a rash of injuries such as scraped hands, elbows, and knees. A number of protective devices are available to prevent or minimize these injuries, including gloves with protected palms.

A more recent entrant to the recreational sports arena is the scooter. The base of a scooter is similar to a skateboard. The rider stands on the base with one foot and provides propulsion with the other. After a chosen speed has been attained, or on downhill surfaces, the rider may place both feet on the base. Unlike a skateboard, a scooter has a T-shaped steering mechanism that extends vertically from the front of the scooter to approximately waist high on the rider. The rider grasps the steering mechanism with both hands and steers the scooter by turning the mechanism to the left or right.

The typical riding position on a scooter places the rider at an increased risk of wrist and/or hand injury. The scooter's horizontal handle bars allow the rider's hand to bend back at the wrist. In the event of a fall, the hand can be bent even farther back upon contact with the ground or other hard surface, causing possible wrist injury or breakage. A fall can also result in hyper-extension of the rider's wrist to one side or the other. In addition, even if the rider's wrist is not hyper-extended backward or side to side during a fall, the rider may suffer impact or abrasion injuries to the hand when coming into contact with the ground or other hard surface.

Some widely-available protective gloves use padding on the underside of the glove to protect the palms and fingers of the user's hand from abrasions in the event of a fall. Constructed in this fashion, the commercial prior art protective gloves are ineffective at preventing or minimizing injuries to the user's wrist and/or lower forearm. These protective gloves will not prevent or minimize the likelihood of the user's wrist hyper-extending backward or side to side in the event of a fall.

Other widely-available protective devices for sports or recreational activities include forearm and wrist protectors that use a rigid or semi-rigid splint member to absorb the impact of a fall and protect the user's wrist from breakage or other injury. Such devices work well when used in activities like skating and snowboarding where minimal hand dexterity is required. Constructed in this fashion, the commercial prior art protective devices are too rigid or uncomfortable to achieve widespread use and acceptance where the user needs the tactile and dextrous use of the hand.

The need remains in the recreational sports industry for a protective scooter glove that will comfortably prevent the user's hand from hyper-extending backward or side to side and protect the user's heel and palm from abrasions while providing sufficient flexibility for gripping and the tactile sense of the hands. The primary objective of this invention is to meet this need.

SUMMARY OF THE INVENTION

More specifically, an object of the invention is to provide a wrist protector having a semi-rigid support plate to absorb the shock generated in a fall and to prevent the user's wrist from hyper-extending backward or side to side.

Another object of the invention is to provide a wrist protector having straps at the wrist and first knuckles that allow the user to control proper sizing and that prevent the semi-rigid support plate from moving during wear to ensure optimal fit and performance of the semi-rigid support plate.

Yet another object of the invention is to protect the heel and palm of the user's hand from impact injuries and abrasions in the event of a fall.

In summary, a protective glove that uses a semi-rigid support plate to protect the user's wrist from hyper-extending backward or side to side, an abrasion resistant palm panel to protect the user's palm and heel from abrasions, and padding to protect the user's heel and palm from impact injuries, all in the event of a fall. A semi-rigid support plate is attached to the back of the scooter glove by means of two sleeves. Two removably connected hook and loop straps tighten the semi-rigid support plate above the user's wrist and first knuckles to ensure optimal fit and comfort to prevent the plate from moving during wear.

Other and further objects of the invention, together with the features of novelty appurtenant thereto, will appear in the description of the drawings.

BRIEF DESCRIPTION OF THE DRAWINGS

In the following description of the drawings, in which like reference numerals are employed to indicate like parts in the various views:

FIG. 1 is a top plan view of the protective glove constructed in accordance with a preferred embodiment of the invention and shown being worn on a user's hand;

FIG. 2 is an enlarged sectional view taken along line 2—2 of FIG. 1 in the directions of the arrows;

FIG. 3 is an enlarged sectional view taken along line 3—3 of FIG. 1 in the directions of the arrows;

FIG. 4 is an enlarged sectional view taken along line 4—4 of FIG. 1 in the directions of the arrows; and FIG. 5 is a perspective view of the semi-rigid support plate for use with the present invention.

DETAILED DESCRIPTION OF THE DRAWINGS

Referring to the drawings in greater detail, attention is first directed to FIGS. 1 & 2. The scooter glove 10 is comprised of a glove body 12 having a palm panel 14 joined with a back panel 16 shaped to conform to the user's hand. The scooter glove 10 has an extended wrist cuff 18 connected to the palm panel 14 and the back panel 16 or formed as an extended portion thereof. Constructed in this fashion, the extended wrist cuff fully covers the wrist and lower forearm of the user. The palm panel 14 and the back panel 16 are suitably shaped so that when connected, they form a thumb stall 19 and finger stalls 20 for receiving the user's thumb and fingers. In the illustrated embodiment, half-finger stalls 19 & 20 are shown for use where tactile feedback or increased finger dexterity is desired by the user. Three-quarter length or full-finger length stalls could be used, however, to provide increased protection from abrasions or insulation from cold.

As seen in FIG. 2, a palm pad 21 and a heel pad 22 are attached to the palm panel 14 to correspond to the heel and palm regions of the user's hand. Additional padding could be attached to the palm panel 14, however, to provide additional protection from impact injuries The back panel 16 is constructed of an inner layer 24 and outer 26 layer. The inner layer 24 resides against the skin of the wearer. As seen in FIGS. 2, 3 & 4, when sewn together, the inner layer 24 and outer layer 26 form an upper pocket sleeve 28 and a lower pocket sleeve 30 that house the semi-rigid support plate 32. As seen in FIG. 2, the inner layer 24 also contains a extended wrist cuff pad 34 that extends under the semi-rigid support plate 32 at the extended wrist cuff 18. The outer layer 26 of the back panel 16 generally corresponds to a portion of the shape of the inner layer 24. In the illustrated embodiment, the outer layer 26 has a diamond shape opening through which the semi-rigid support plate 32 is revealed. However, the opening could be oval, rectangular, round, square or any other shape that will allow removal and installation of the semi-rigid support plate 32. Affixed to the outer layer 26 is a hook and loop fastener 36 positioned just above the location of the user's first knuckles.

The scooter glove 10 contains two locking straps 38 & 40 that fix the semi-rigid support plate 32 in relation to the lower forearm and first knuckle of the user. As seen in FIGS. 1 & 4, the upper locking strap 38 is attached to the palm portion 14 on the side away from the thumb stall 19. A loop 42 is attached to the palm panel 14 on the same side as the thumb stall 19. The upper locking strap 38 passes over the back panel 16 at the extended wrist cuff 18, through the loop 42 and then is removably connected to itself by a hook and loop fastener 44. Although a hook and loop fastener 44 is seen in the illustrated embodiment, a removable connection could be attained through use of a buckle or other suitable locking mechanism.

As seen in FIGS. 1 & 3, the lower locking strap 40 is attached to the palm panel 14 on the same side as the thumb stall 19. A loop 44 is attached to the palm portion 14 on the side away from the thumb stall 19. The lower locking strap 40 passes over the upper panel 16 and is removably connected to it by a hook and loop fastener 36, commercially available as VELCRO. The VELCRO 36 prevents the lower locking strap 40 from moving either toward the finger stalls 20 or the extended wrist cuff 18. The lower support strap passes through the loop 44 and then is removably connected to itself by another VELCRO fastener 46. Although a VELCRO fastener 46 is seen in the illustrated embodiment, a removable connection could be attained through use of a buckle or other locking mechanism.

The semi-rigid support plate 32 is manufactured from of a material with a limited range of flexibility. The support plate 32 stiffens the scooter glove 10 by limiting side to side and forward to back movement. Side to side movement is limited by the semi-rigid support plate 32 to no more than two or three degrees. The support plate 32 provides increasing resistance to forward to back movement and becomes inflexible at approximately 90 degrees. In the illustrated embodiment, the semi-rigid support plate 32 is made of a fixed-density material and has three evenly spaced, offset notches 48 on each side, which allow limited resilient flexure. The semi-rigid support plate 32 in the illustrated embodiment is generally designed to flex from 0 to 90 degrees. Similar limited resilient flexure could be obtained, however, by use of a number of alternative structures such as one or more lateral grooves cut across the short axis of the support plate or a support plate manufactured from multiple-density material. These alternative designs will allow the semi-rigid support plate 32 to flex within the range described above. As seen in FIG. 5, a layer of padding 49 is affixed to the underside of the plate and wraps around the plate 32 at its forward and rear positions.

In operation, the scooter glove 10 fits securely over the user's hand as seen in FIG. 1. The semi-rigid support plate 32, housed between the inner 24 and outer 26 layers of the back panel 16, is curved convexly relative to the back panel 16 to generally conform to the shape of the back of the user's wrist and hand. The semi-rigid support plate 32 is drawn snugly to the user's hand when the upper 38 and lower 40 locking straps support straps are selectively fastened snugly. The semi-rigid support plate 32 prevents the user's hand from hyper-extending back toward the wrist or from side to side.

Padding 21 & 22 is positioned under the palm panel 14 of the scooter glove 10 to protect the areas of the user's hand most likely to contact the ground in the event of a fall: the palm and the heel of the hand. The padding 21 & 22 will prevent or minimize the abrasions that are likely to occur in the event of a fall.

Constructed and operated as previously described, this invention protects the user's wrist and lower forearm from injuries caused hyper-extension of the hand backward or side to side. The upper and lower support bands secure the semi-rigid support plate in position at both the wrist and first knuckles and ensure that the protective plate does not move during wear.

In addition, the lower and upper support bands allow the user to customize the fit of the protective glove by controlling the amount of tension placed on the support bands.

In addition, this invention provides protection to the palm and heel of the user's hand through padding attached to the bottom panel of the glove.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

NUMERALS scooter glove 10
glove body 12
- palm panel 14
- back panel 16
  - inner panel 24
  - outer panel 26
- extended wrist cuff 18
- finger stalls 20
- thumb stall 19 palm padding 21
heel padding 22
upper pocket sleeve 28
lower pocket sleeve 30
semi-rigid support plate 32
- evenly spaced notches 48 extended wrist cuff pad 34
knuckle region VELCRO fastener 36
upper locking strap 38
lower locking strap 40 upper strap loop 42
upper locking strap VELCRO fastener 44
lower locking strap VELCRO fastener 46

Having thus described my invention, I claim:

1. A protective glove for the hand, wrist, and lower forearm of a user, said protective glove comprising:

a glove body, said glove body having at least a back panel, a palm panel connected along opposite sides thereof to said back panel, finger and thumb stalls connected along a first end of said back and palm panels, and extended wrist cuff connected along a second end of said back and palm panels;

said back panel formed from at least an inner layer and an outer layer and including a hand protective region and a knuckle protective region;

a pocket sleeve formed by said inner and outer layers and having a first end coterminous with said knuckle protective region and a second end coterminous with said extended wrist cuff;

a semi-rigid support plate received in said pocket sleeve and sized to snugly fit in said first and second ends of said pocket sleeve, said semi-rigid support plate curved convexly relative to said back panel;

a first locking strap connected to said glove body to overlie said knuckle protective region and said first end of said pocket sleeve to firmly hold said protective plate to said knuckle protective region;

a locking member attached to said upper panel at said knuckle protective region to which the first locking strap is removably connected whereby said locking member prevents said first locking strap from moving either toward said finger stalls or toward said extended wrist cuff; and an second locking strap connected to said glove body to overlie said extended wrist cuff and said second end of said pocket sleeve to firmly hold said semi-rigid protective plate to the extended wrist cuff;

whereby said first and second locking straps snugly lock said semi-rigid support plate to the user's hand at said protective knuckle region and at said extended wrist cuff thereby preventing the user's hand from hyper-extending backward or side to side by allowing only limited flexure while permitting tactile and dextrous use of the user's hand.

2. The protective glove as in claim 1 further comprising:

at least one abrasion resistant pad carried on the palm panel of said glove;

whereby said protective glove prevents or minimizes impact injuries to the palm and heel regions of the user's hand in the event of a fall.

3. The protective glove as in claim 2, said protective glove further comprising:

said palm panel containing a heel region residing between said knuckle protective region and said extended wrist cuff;

a plurality of abrasion resistant pads carried on the palm panel of said glove, wherein said plurality of pads includes a first pad connected to said palm panel opposite the knuckle protective region of said glove and a second pad connected to said heel region of said glove;

whereby said protective glove prevents or minimizes impact injuries to the palm and heel regions of the user's hand in the event of a fall.

4. A protective glove as in claim 1, said protective glove further comprising:

padding in said pocket sleeve adjacent said second end coterminous with said extended wrist cuff, said padding positioned between said semi-rigid support plate and said inner layer of said back panel;

whereby the padding cushions the user's wrist from any pressure created when the upper locking strap is tightened and absorbs force generated when the wearer's hand contacts any hard surface in the event of a fall.

5. A protective glove as in claim 1, said protective glove further comprising:

an abrasion resistant palm panel;

whereby said protective glove prevents or minimizes abrasions to the palm and heel regions of the user's hand in the event of a fall.

6. A protective glove as in claim 1, said protective glove further comprising:

said semi-rigid support plate comprising an upper side and a lower side, said upper side positioned against said outer layer of said back panel and said lower side positioned against said inner layer of said back panel;

padding attached to the said semi-rigid support plate on lower side of said semi-rigid support plate;

whereby the padding cushions the user's hand and wrist from pressure created when the upper and lower locking straps are tightened and absorbs force generated when the wearer's hand contacts any hard surface in the event of a fall.

7. A protective glove as in claim 1, said protective glove further comprising:

said finger and thumb stalls comprising a plurality of half-finger stalls;

whereby the protective glove is appropriate for use in warm weather and in activities where tactile feedback or increased finger dexterity is desired by the user.

* * * * *